US007117974B2

(12) United States Patent
Moenssen et al.

(10) Patent No.: US 7,117,974 B2
(45) Date of Patent: Oct. 10, 2006

(54) ELECTRONICALLY CONTROLLED DUAL CHAMBER VARIABLE RESONATOR

(75) Inventors: David J. Moenssen, Canton, MI (US); John D. Kostun, Brighton, MI (US); Christopher E. Shaw, Canton, MI (US); Lakhi N. Goenka, Ann Arbor, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 350 days.

(21) Appl. No.: 10/846,327

(22) Filed: May 14, 2004

(65) Prior Publication Data

US 2005/0252716 A1 Nov. 17, 2005

(51) Int. Cl.

| | |
|---|---|
| ***F01N 1/16*** | (2006.01) |
| ***F02M 35/12*** | (2006.01) |
| *F01N 1/02* | (2006.01) |
| *F02M 35/10* | (2006.01) |
| *F02M 35/14* | (2006.01) |

(52) U.S. Cl. ..... 181/277; 181/278; 181/250; 181/266; 181/273; 181/276; 123/184.55; 123/184.57

(58) Field of Classification Search ..... 181/277, 181/278, 250, 266, 273, 276; 123/184.57, 123/184.55

See application file for complete search history.

(56) References Cited

U.S. PATENT DOCUMENTS

| | | | | |
|---|---|---|---|---|
| 1,291,271 | A * | 1/1919 | Tvedt | 181/271 |
| 1,859,400 | A * | 5/1932 | Kersey | 181/278 |
| 2,214,894 | A * | 9/1940 | Wilson | 123/198 R |
| 2,297,046 | A | 9/1942 | Bourne | |
| 2,323,955 | A | 7/1943 | Wilson | |
| 3,141,519 | A * | 7/1964 | Bottum | 181/241 |
| 3,642,095 | A | 2/1972 | Fujii | |
| 3,920,095 | A | 11/1975 | Clark | |
| 3,940,721 | A | 2/1976 | Kojima et al. | |
| 3,990,414 | A * | 11/1976 | Malphettes | 123/184.57 |
| 4,539,947 | A | 9/1985 | Sawada et al. | |
| 4,546,733 | A | 10/1985 | Kukami et al. | |
| 4,874,062 | A * | 10/1989 | Yanagida et al. | 181/250 |
| 5,283,398 | A | 2/1994 | Kotera et al. | |
| 5,349,141 | A | 9/1994 | Horibe et al. | |
| 5,377,629 | A | 1/1995 | Brackett et al. | |
| 5,475,189 | A | 12/1995 | Field et al. | |
| 5,619,020 | A * | 4/1997 | Jones et al. | 181/206 |

(Continued)

FOREIGN PATENT DOCUMENTS

DE 3814836 A1 * 12/1988

*Primary Examiner*—Edgardo San Martin
(74) *Attorney, Agent, or Firm*—Brinks Hofer Gilson & Lione

(57) ABSTRACT

An in-line resonator for an air induction system of an internal combustion engine is provided. The system includes a resonator housing, an upstream duct, a downstream duct, a conduit, a partition, and a sleeve. The conduit extends through the resonator housing connecting the upstream duct and the downstream duct. The partition is moveable within the resonator housing and divides the housing into an upstream chamber and a downstream chamber. The downstream chamber, the conduit, and the downstream sleeve cooperate to form a first Helmholtz resonator that is in fluid communication with the downstream duct. The upstream chamber, the conduit, and the upstream sleeve cooperate to form a second Helmholtz resonator that is in fluid communication with the upstream duct. Further, a means is provided to axially move the partition to vary the volume of the chambers concurrently with the length and/or area of the passages.

15 Claims, 3 Drawing Sheets

U.S. PATENT DOCUMENTS 5,628,287 A 5/1997 Brackett et al.
5,771,851 A * 6/1998 McLean ..... 123/184.57
5,839,405 A 11/1998 Falkowski et al.
5,894,823 A 4/1999 Lee
5,921,081 A 7/1999 Kim
5,979,598 A 11/1999 Wolf et al.
6,135,079 A 10/2000 Fuesser
6,178,745 B1 1/2001 Meusen
6,408,810 B1 6/2002 Leipelt et al.
6,422,192 B1 7/2002 Bloomer
6,431,136 B1 8/2002 Pietrowski et al.
6,494,290 B1 12/2002 Jessberger
6,508,331 B1 1/2003 Stuart
6,609,489 B1 8/2003 Slopsema et al.
6,634,457 B1 10/2003 Paschereit et al.
6,644,436 B1 11/2003 Hofmann et al.
6,681,888 B1 * 1/2004 Lepoutre ..... 181/249
6,698,390 B1 * 3/2004 Kostun et al. ..... 123/184.57
6,732,510 B1 * 5/2004 Ciray ..... 60/312
6,769,511 B1 * 8/2004 Brooks et al. ..... 181/241
6,792,907 B1 * 9/2004 Kostun et al. ..... 123/184.57
6,901,752 B1 * 6/2005 Uhler et al. ..... 60/312
6,915,876 B1 * 7/2005 Ciray ..... 181/219
2002/0088227 A1 7/2002 Jarvi
2005/0199439 A1 * 9/2005 Goenka et al. ..... 181/250
2005/0205354 A1 * 9/2005 Goenka et al. ..... 181/277
2005/0217626 A1 * 10/2005 Kino et al. ..... 123/184.57

* cited by examiner

ELECTRONICALLY CONTROLLED DUAL CHAMBER VARIABLE RESONATOR

BACKGROUND

1. Field of the Invention

The present invention generally relates to an in-line resonator for an air induction system.

2. Description of Related Art

Resonators for attenuating acoustic pressure pulsations in automotive applications are well known. The air induction systems of internal combustion engines produce undesirable noise in the form of acoustic pressure pulsations. This induction noise varies based on the engine configuration and engine speed. The induction noise is caused by a pressure wave that travels from the inlet valve towards the inlet of the air induction system. Further, the induction noise may be reduced by reflecting a wave toward the inlet valve 180° out of phase with the noise wave. As such, Helmholtz type resonators have been used to attenuate the noise wave generated from the inlet valve-opening event. In addition and more recently, resonators have been developed that change the volume of the resonator to adjust for varying frequencies of the noise wave, as engine speed changes. Previous designs, however, have not provided the control of multiple frequencies at the same engine speed, which is required for some applications.

To meet order based air induction noise targets, it is generally necessary to incorporate a tuning device, such as a resonator, into the air induction system. Traditional static resonators are tuned to a fixed frequency that will not change with engine speed. These resonators provide notch-type attenuation at their designated frequency, but introduce undesirable side band resonances at higher and lower frequencies. Even after the addition of multiple static devices, it may still not be possible to match the desired order based targets due to the notch-type attenuation and side band amplification caused by such devices. Resonators have been developed that change the volume of the resonator to adjust for the varying frequencies of the noise wave as engine speed changes. However, the acoustic pressure pulsations may be composed of several frequencies of significant amplitude that occur simultaneously at any given engine speed.

In view of the above, it is apparent that there exists a need for an improved resonator having broader flexibility to attenuate the various noise frequencies of the engine.

SUMMARY

In satisfying the above need, as well as overcoming the drawbacks and other limitations of the related art, the present invention provides an in-line resonator with multiple chambers for an air induction system of an internal combustion engine.

The system includes a resonator housing, an upstream duct, a downstream duct, a conduit, a partition, an upstream sleeve, and a downstream sleeve. The upstream duct and downstream duct are connected to opposite ends of the housing. The upstream duct connects the resonator to the air intake, and the downstream duct connects the resonator to the internal combustion engine. The conduit extends through the resonator housing providing an airflow path between the upstream duct and downstream duct. The partition divides the housing into an upstream chamber and a downstream chamber. Additionally, the partition, downstream sleeve, and upstream sleeve are fixed to each other so that these components always maintain the same relative position with respect to each other. The partition, downstream sleeve, and upstream sleeve are collectively referred to as the sliding unit of the resonator assembly. The downstream and upstream sleeves slide along the outside of the conduit while the airflow from the upstream duct to the downstream duct is bounded by the inner surface of the conduit. The downstream chamber, conduit, and downstream sleeve cooperate to form a downstream Helmholtz resonator that is in fluid communication with the downstream duct. The properties of the Helmholtz resonator are characterized by the volume of the downstream chamber and the length and cross-sectional area of the passage connecting the downstream duct to the downstream chamber.

In another aspect of the present invention, the conduit and the upstream sleeve may include overlapping openings that form a fluid communication path from the interior of the conduit to the upstream chamber. The upstream chamber and the overlapping openings of the upstream sleeve and conduit form an upstream Helmholtz resonator. The overlapping openings of the conduit and upstream sleeve may have a variety of shapes thereby varying the frequency of the second Helmholtz resonator as a function of the relative positions of the upstream duct and conduit.

In another aspect of the present invention, the downstream sleeve may be composed of an outer downstream sleeve and an inner downstream sleeve. The outer downstream sleeve is spaced apart from the inner downstream sleeve. The inner downstream sleeve slides about the conduit, and the outer downstream sleeve slides within the downstream duct. The gap between the inner and outer downstream sleeves defines the area of the passage connecting the downstream duct and the downstream chamber.

In a further aspect of the present invention, the outer downstream sleeve has an end that extends into the downstream chamber. The distance from the end of the conduit that terminates within the downstream duct and the end of the outer downstream sleeve that terminates within the downstream chamber defines the length of the passage between the downstream duct and the downstream chamber.

In another aspect of the present invention, the means for axially moving the sliding unit includes a motor mounted on the resonator housing and an actuator connecting the motor to the sliding unit.

In yet another aspect of the present invention, the conduit may contain a plurality of perforations. As a function of the position of the upstream sleeve, the upstream sleeve will act to cover or uncover a portion of the perforations in the conduit. The uncovered perforations form a fluid communication path to the upstream chamber. The upstream chamber and the uncovered perforations in the conduit form an upstream Helmholtz resonator.

Further objects, features and advantages of this invention will become readily apparent to persons skilled in the art after a review of the following description, with reference to the drawings and claims that are appended to and form a part of this specification.

DETAILED DESCRIPTION

Figure 1:
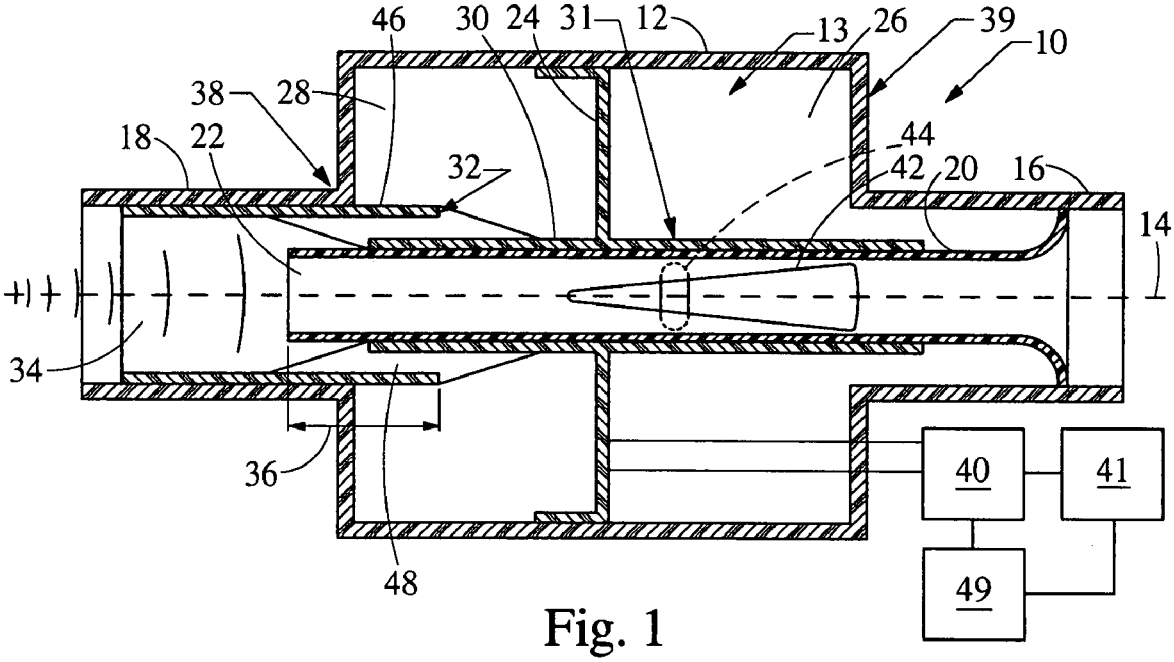
FIG. 1 is a longitudinal sectional view of an in-line resonator embodying the principles of the present invention.

Referring now to FIG. 1, an in-line resonator embodying the principles of the present invention is illustrated therein and designated at 10. As its primary components, the in-line resonator 10 includes a resonator housing 12, a conduit 20, a partition 24, a downstream sleeve 30, and an upstream sleeve 31.

The housing 12 of the in-line resonator 10 forms a compartment 13 having a fixed volume. Extending from the ends of the housing 12 are an upstream duct 16 and a downstream duct 18. Positioned axially within the in-line resonator 10 and providing an airflow passage from the upstream duct 16 to the downstream duct 18 is the conduit 20. The conduit 20 is centered on the axis 14 of the resonator housing 12 and air flows generally into the upstream duct 16, through the conduit 20, into the downstream duct 18, and to the internal combustion engine (not shown). Acoustic pressure pulsations created by the air induction process travel from the engine into the downstream duct 18.

Located axially around the conduit 20 and attached to the partition 24 for sliding therewith are a downstream sleeve 30 and an upstream sleeve 31. The downstream sleeve 30, the upstream sleeve 31, the partition 24, and the resonator housing 12 cooperate to form a first or downstream chamber 28 and second or upstream chamber 26. The downstream sleeve 30 includes an outer downstream sleeve 46 that is spaced apart from the conduit 20 and that defines an outer downstream sleeve end 32 extending into the downstream duct 18 and downstream chamber 28. The outer downstream sleeve end 32 in cooperation with the conduit end 22 defines an annular connector passage 48. Further, a length 36 is defined from the conduit end 22 to the outer downstream sleeve end 32.

To attenuate the acoustic pressure pulsations, the first chamber 28, and the annular connector passage 48 form a first or downstream Helmholtz resonator 38. As the acoustic pressure pulsations enter the downstream resonator 38, the location of the partition 24, the downstream sleeve 30, and outer downstream sleeve 46 within the housing 12 are adjusted by the actuator 40 to create the necessary internal dimensions that will reflect the acoustic pressure pulsations back into the downstream duct with a 180° phase shift at the desired frequency, thereby attenuating the acoustic pressure pulsations.

To further attenuate the acoustic pressure pulsations, the second chamber 26, the opening 42 in the conduit, and the opening 44 in the upstream sleeve cooperate to form a second or upstream Helmholtz resonator 39. As the acoustic pressure pulsations travel through the conduit 20, they enter the second chamber 26 through the overlapping areas of the conduit opening 42 and the upstream sleeve opening 44. Both of the openings 42 and 44 are further defined below. The frequency attenuated by the upstream resonator 39 is controlled by the position of the partition 24, the size and shape of the opening formed by the overlapping or relative positions of the conduit opening 42 and the sleeve opening 44, and the wall thickness of the conduit 20 and upstream sleeve 31.

The upstream resonator 39 offers greater flexibility to address additional frequencies in need of attenuation, while the first resonator 38 addresses a single dominant order. If the intake manifold is acoustically symmetric, then an acoustic pressure pulsation signature composed of the engine firing order and its harmonics will dominate the induction noise. As a result the downstream resonator 38 can address the dominant engine order, and the upstream resonator 39 can be tailored to address additional problematic frequencies, as described in the paragraphs below.

Controller 41 monitors engine parameters, such as engine speed, engine acceleration, throttle position, and pedal position. The controller 41 calculates the optimal position of the partition 24 based on the engine parameters. In doing this, controller 41 can utilize a lookup table of the partition position relative to both engine speed and performance characteristics. The lookup table could be developed from a series of induction noise tests to determine the optimal position for the partition at every engine speed. In addition, a position sensor 49 may be used to monitor the position of the partition 24 and provide feedback to the controller 41. Based on the feedback from the position sensor 49 and the engine's operating conditions, the controller commands the actuator 40 to move the partition 24 to the predetermined optimal position.

Figure 2:
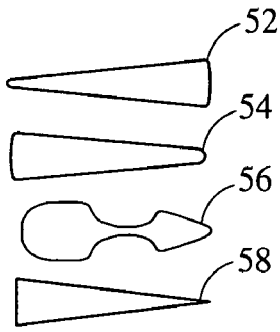
FIG. 2 is a chart depicting various hole configurations used to vary the frequency attenuation of the upstream chamber.
Figure 3:
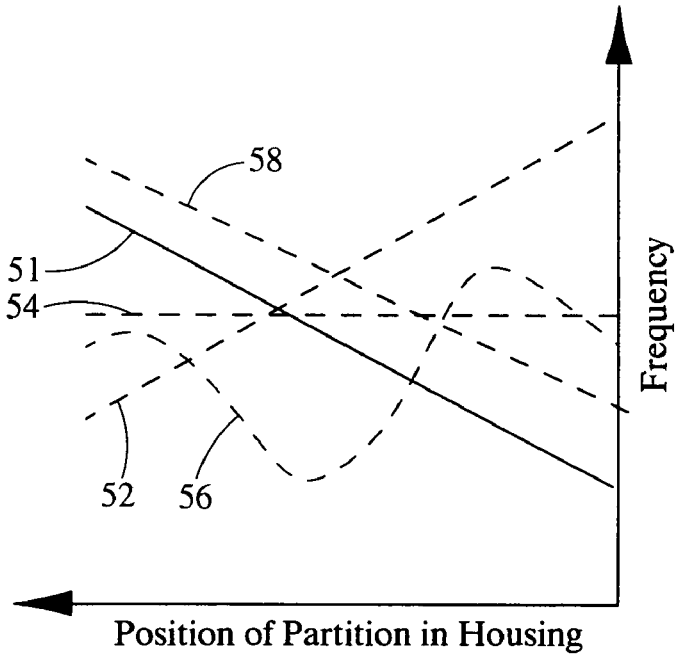
FIG. 3 is a graph showing the frequency attenuated by the upstream chamber for various conduit hole configurations as varied by the partition being moved across the resonator.

Now referring to FIG. 2 and FIG. 3, examples of various shaped conduit holes are provided along with graphs of the resulting frequency of attenuation achieved by each conduit hole as the upstream sleeve 31 slides along the conduit 20. For reference, the attenuation provided by downstream resonator is designated by reference numeral 51. Further, it is to be noted, that the opening formed by the cooperation of the conduit opening 42 together with the upstream sleeve opening 44 significantly varies the frequency attenuated by the second resonator 39. Accordingly, either the conduit opening 42, the upstream sleeve opening 44, or both may be altered in size and shape along the length of the opening to obtain desired attenuation characteristics. Utilizing the oval shape of the upstream sleeve opening 44, as shown in FIG. 1, a first wedge-shaped conduit opening 52 with the apex pointing towards the downstream duct 18 allows the attenuated frequency decrease while the volume of the second chamber 26 increases, as defined by the position of the partition 24. The angle along the length of the first wedge shape 52 can be modified to vary the rate at which the frequency decreases as the volume of he second chamber 26 increases.

Utilizing a second wedge shape 54, with the apex pointing towards the upstream duct 16, the angle of the apex can be chosen to attenuate a constant frequency as the upstream sleeve 30 moves along the conduit 20. The second wedge shape 54 essentially compensates for the increase in the volume of the second chamber 26 by changing the size and shape of the conduit opening, as shown by second wedge shape 54 and its corresponding graph.

In addition, non-linear transfer functions between the position of the partition 24 and the attenuated frequency can be created by changing the angle of the apex and shape of the sides in a non-linear manner. One example is provided in the violin-shaped wedge 56.

In contrast to the first wedge shape 52, the frequency may be increased using a third wedge shape 58 as the sleeve 30 moves along the conduit 32. The third wedge shape 58 has an apex pointing towards the upstream duct 16, however, the apex angle is wider than the second wedge shape 54.

Figure 4:
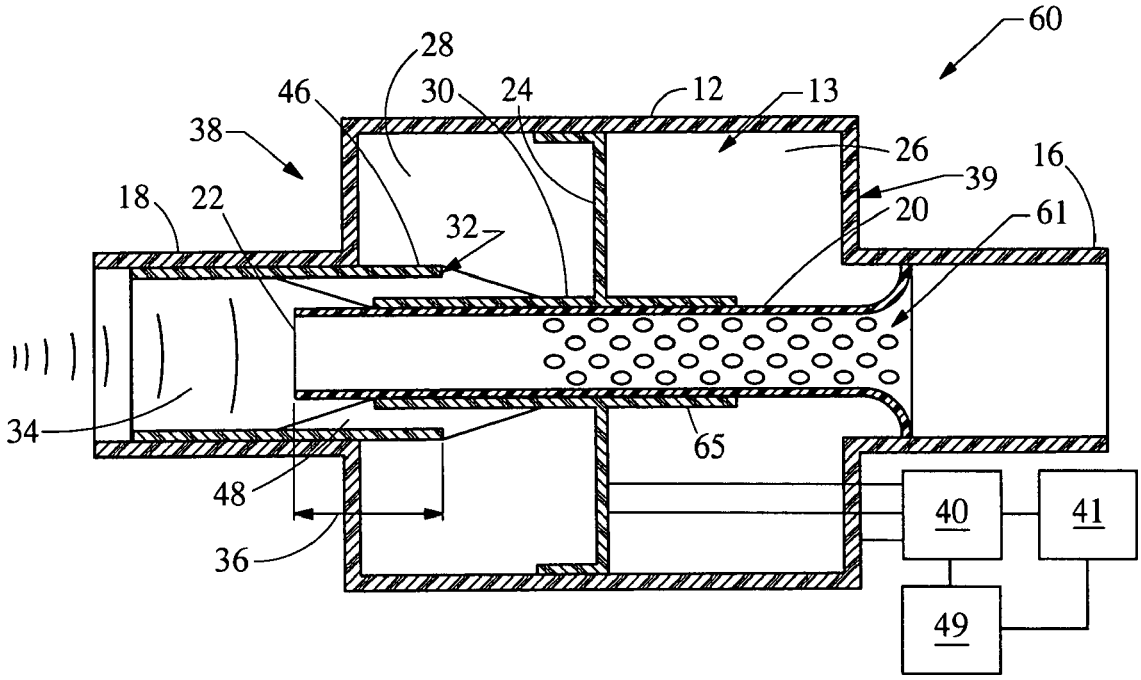
FIG. 4 is a sectional side view of another embodiment of a in-line resonator having perforations in the conduit.

Referring now to FIG. 4, another embodiment of in-line resonator according to the principles of the present invention is illustrated therein and designated at 60. It is noted that common components with the previously described exponent are referenced with common element numbers.

As its primary components, the in-line resonator 60 includes a resonator housing 12, a conduit 20, a partition 24, a downstream sleeve 30, and an upstream sleeve 65. The housing 12 of the in-line resonator 60 forms a compartment 13 having a fixed volume. Extending from the ends of the housing 12 are an upstream duct 16 and a downstream duct 18. Positioned axially within the in-line resonator 60 and providing a passage from the upstream duct 16 to the downstream duct 18 is the conduit 20. Generally, air flows into the upstream duct 16, through the conduit 20, and out the downstream duct 18 to the internal combustion engine (not shown). Acoustic pressure pulsations created by the air induction process travel from the engine into the downstream duct 18.

Located axially around the conduit 20 and attached to the partition 24, for sliding therewith, are a downstream sleeve 30 and an upstream sleeve 65. The downstream sleeve 30, the upstream sleeve 65, the partition 24, and the resonator housing 12 cooperate to form a first or downstream chamber 28 and a second or upstream chamber 26. The downstream sleeve 30 includes an outer downstream sleeve 46 that is spaced apart from the conduit 20 that defines an outer downstream sleeve end 32 extending into the downstream duct 18 and downstream chamber 28. The outer downstream sleeve end 32 in cooperation with the conduit end 22 defines an annular connector passage 48. Further, a length 36 is defined from the conduit end 22 to the outer downstream sleeve end 32.

To attenuate the acoustic pressure pulsations, the first chamber 28, and the annular connector passage 48 form a first or downstream Helmholtz resonator 38. As the acoustic pressure pulsations enter the resonator 38, the location of the partition 24, the downstream sleeve 30, and outer downstream sleeve 46 within the housing 12 are adjusted by the actuator 40 to create the necessary internal dimensions that will reflect the acoustic pressure pulsations back into the downstream duct with a 180° phase shift at the desired frequency, thereby attenuating the acoustic pressure pulsations.

To further attenuate the acoustic pressure pulsations, a second chamber 26, the perforated openings 61 in the conduit 20, and the position of the upstream sleeve 65 cooperate to form a second or upstream Helmholtz resonator 39. As the acoustic pressure pulsations travel through the conduit 20, perforations 61 in the conduit 20 allow the acoustic pressure pulsation to enter the second chamber 26. The frequency attenuated by the upstream resonator 39 is controlled by the position of the partition 24, the wall thickness of the conduit 20, as well as the amount of perforations 61 not covered by the upstream sleeve 30 based on the position of the upstream sleeve 30.

Controller 41 monitors engine parameters, such as engine speed, engine acceleration, throttle position, and pedal position. The controller 41 calculates the optimal position of the partition 24 based on the engine parameters. In doing this, controller 41 can utilize a lookup table of the partition position relative to both engine speed and performance characteristics. The lookup table could be developed from a series of induction noise tests to determine the optimal position for the partition at every engine speed. In addition, a position sensor 49 may be used to monitor the position of the partition 24 and provide feedback to the controller 41. Based on the feedback from the position sensor 49 and the engine's operating conditions, the controller commands the actuator 40 to move the partition 24 to the predetermined optimal position.

Figure 5:
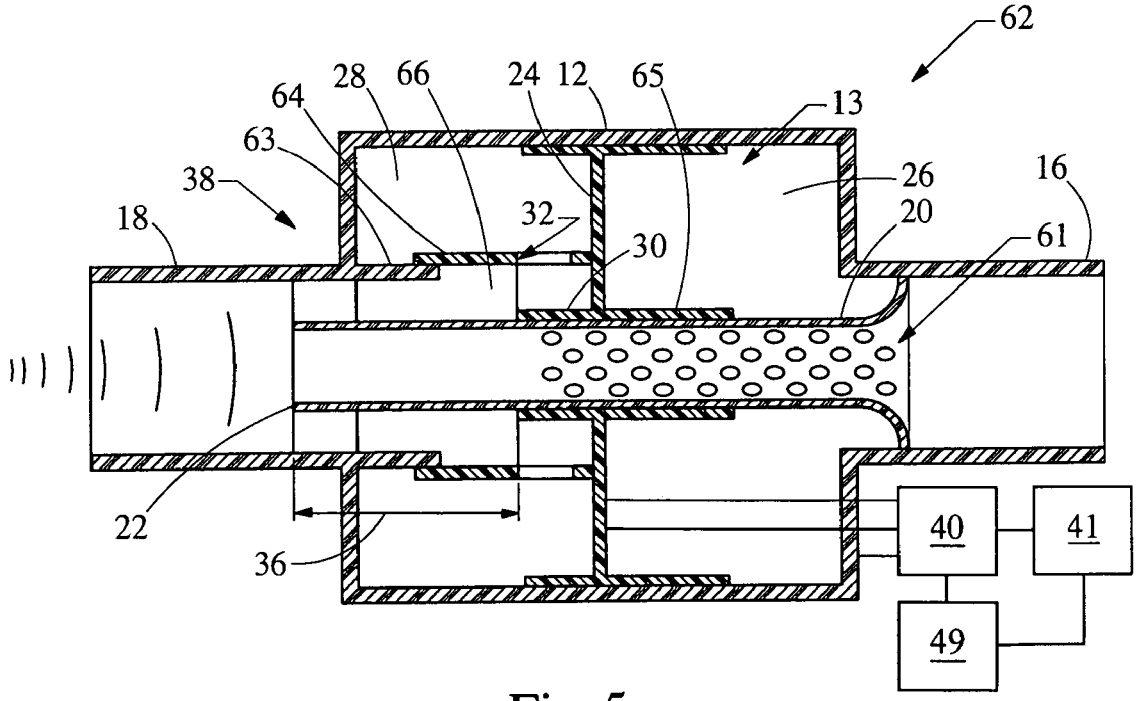
FIG. 5 is a sectional side view of another embodiment of an in-line resonator having an extension of the downstream duct protruding into the downstream chamber.

Referring now to FIG. 5, another embodiment of in-line resonator according to the principles of the present invention is illustrated therein and designated at 62. Again, common components to those of the preceding embodiments one designated with like reference numbers. As its primary components, the in-line resonator 62 includes a resonator housing 12, a conduit 20, a partition 24, a downstream sleeve 30, and an upstream sleeve 65.

The housing 12 of the in-line resonator 62 forms a compartment 13 having a fixed volume. Extending from the ends of the housing 12 are an upstream duct 16 and a downstream duct 18. Positioned axially within the in-line resonator 62 providing a passage from the upstream duct 16 to the downstream duct 18 is the conduit 20. Generally, air flows into the upstream duct 16, through the conduit 20, and out the downstream duct 18 to the internal combustion engine (not shown). Acoustic pressure pulsations created by the air induction process travel from the engine into the downstream duct 18.

Located axially around the conduit 20 and attached to the partition 24 for sliding therewith are a downstream sleeve 30 and an upstream sleeve 31. The downstream sleeve 30, the upstream sleeve 65, the partition 24, and the resonator housing 12 cooperate to form a first or downstream chamber 28 and second or upstream chamber 26. The downstream sleeve 30 includes an outer downstream sleeve 64 that is spaced apart from the conduit 20 and that defines an outer downstream sleeve end 32 extending into the downstream chamber 28. In addition, the downstream duct has an extension 63 that extends into the downstream chamber 28 around which the outer downstream sleeve 64 slides. The conduit end 22, the downstream duct extension 63, and the outer downstream sleeve 64 cooperate to define an annular passage 66. Further, a length 36 is defined from the conduit end 22 to the outer downstream sleeve end 32.

To attenuate the acoustic pressure pulsations, the downstream chamber 28 and the annular passage 66 cooperate to form a first or downstream Helmholtz resonator 38. As the acoustic pressure pulsations enter the downstream resonator 38, the location of the partition 24, the downstream sleeve 30, and outer downstream sleeve 46 within the housing 12 are adjusted by the actuator 40 to create the necessary internal dimensions that will reflect the acoustic pressure pulsations back into the downstream duct with a 180° phase shift at the desired frequency, thereby attenuating the acoustic pressure pulsations.

To further attenuate the acoustic pressure pulsations, a second chamber 26, the perforated openings 61 in the conduit 20, and the position of the upstream sleeve 65 cooperate to form a second or upstream Helmholtz resonator 39. As the acoustic pressure pulsations travel through the conduit 20, perforations 61 in the conduit 20 allow the acoustic pressure pulsation to enter the second chamber 26. The frequency attenuated by the upstream resonator 39 is controlled by the position of the partition 24, the wall thickness of the conduit 20, as well as the amount of perforations 61 not covered by the upstream sleeve 30 based on the position of the upstream sleeve 30.

Controller 41 monitors engine parameters, such as engine speed, engine acceleration, throttle position, and pedal position. The controller 41 calculates the optimal position of the partition 24 based on the engine parameters. In doing this, controller 41 can utilize a lookup table of the partition position relative to both engine speed and performance characteristics. The lookup table could be developed from a series of induction noise tests to determine the optimal position for the partition at every engine speed. In addition, a position sensor 49 may be used to monitor the position of the partition 24 and provide feedback to the controller 41. Based on the feedback from the position sensor 49 and the engine's operating conditions, the controller commands the actuator 40 to move the partition 24 to the predetermined optimal position.

Figure 6:
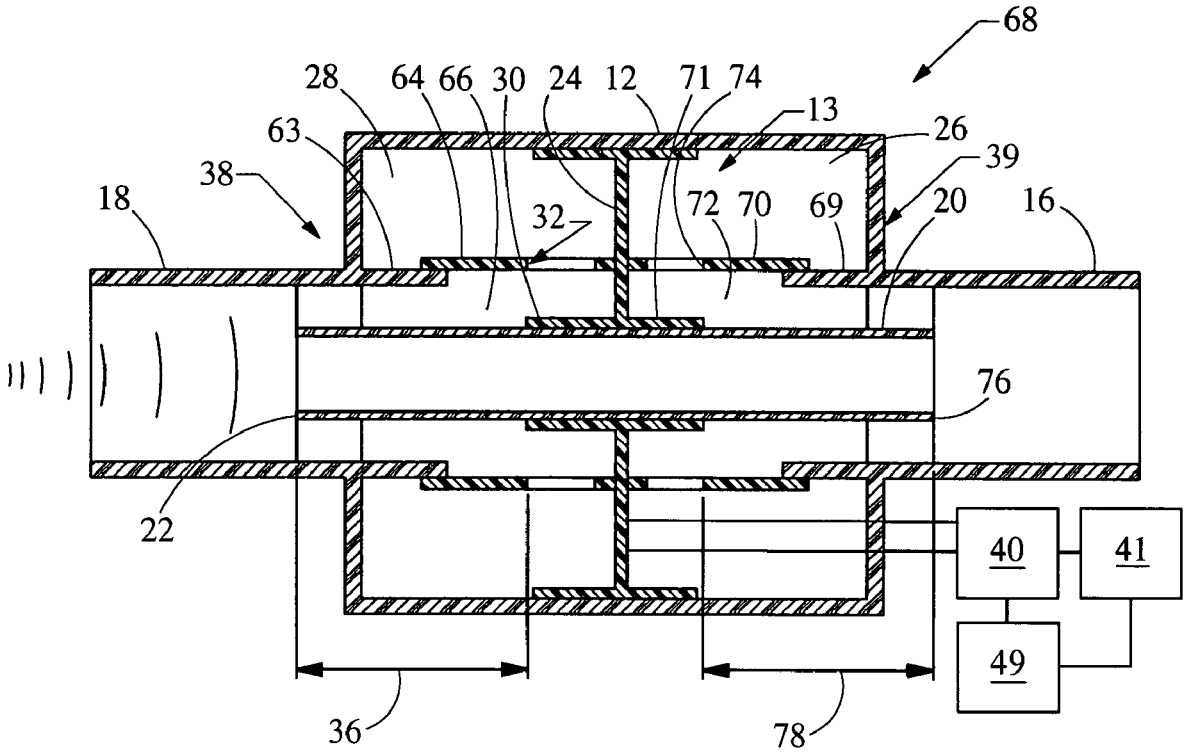
FIG. 6 is a sectional side view of yet another embodiment of an in-line resonator where the upstream and downstream ducts have extensions that protrude into the upstream and downstream chambers.

Referring now to FIG. 6, another embodiment of in-line resonator according to the principles of the present invention is illustrated therein and designated at 68. Again, common components to those of the preceding embodiments one designated with like reference numbers. As its primary components, the in-line resonator 68 includes a resonator housing 12, a conduit 20, a partition 24, a downstream sleeve 30, and an upstream sleeve 71.

The housing 12 of the in-line resonator 68 forms a compartment 13 having a fixed volume. Extending from the ends of the housing 12 are an upstream duct 16 and a downstream duct 18. The conduit 20 is positioned axially within the in-line resonator 68 providing a passage from the upstream duct 16 to the downstream duct 18. Generally, air flows into the upstream duct 16, through the conduit 20, and out the downstream duct 18 to the internal combustion engine (not shown). Acoustic pressure pulsations created by the air induction process travel from the engine into the downstream duct 18.

Located axially around the conduit 20 and attached to the partition 24 for sliding therewith are a downstream sleeve 30 and an upstream sleeve 71. The downstream sleeve 30, the upstream sleeve 71, the partition 24, and the resonator housing 12 cooperate to form a first or downstream chamber 28 and second or upstream chamber 26. The downstream sleeve 30 includes an outer downstream sleeve 64 that is spaced apart from the conduit 20 and that defines an outer downstream sleeve end 32 extending into the downstream chamber 28. The downstream duct has an extension 63 that extends into the downstream chamber 28 around which the outer downstream sleeve 64 slides. The conduit end 22, the downstream duct extension 63, and the outer downstream sleeve 64 cooperate to define an annular passage 66. Further, a length 36 is defined from the conduit end 22 to the outer downstream sleeve end 32.

In addition, the upstream sleeve 71 includes an outer upstream sleeve 70 that is spaced apart from the conduit 20 and that defines an outer upstream sleeve end 74 extending into the upstream chamber 26. The upstream duct has an extension 69 that extends into the downstream chamber 26 around which the outer upstream sleeve 70 slides. The conduit end 76, the upstream duct extension 69, and the outer upstream sleeve 70 cooperate to define an annular passage 72. Further, a length 78 is defined from the conduit end 76 to the outer upstream sleeve end 74.

To attenuate the acoustic pressure pulsations, the downstream chamber 28 and the annular passage 66 cooperate to form a first or downstream Helmholtz resonator 38. As the acoustic pressure pulsations enter the downstream resonator 38, the location of the partition 24, the downstream sleeve 30, and outer downstream sleeve 46 within the housing 12 are adjusted by the actuator 40 to create the necessary internal dimensions that will reflect the acoustic pressure pulsations back into the downstream duct with a 180° phase shift at the desired frequency, thereby attenuating the acoustic pressure pulsations.

To further attenuate the acoustic pressure pulsations, the upstream chamber 26 and the annular passage 72 cooperate to form a second or upstream Helmholtz resonator 39. As the acoustic pressure pulsations enter the upstream resonator 39, the location of the partition 24, the upstream sleeve 71, and outer upstream sleeve 70 within the housing 12 are adjusted by the actuator 40 to create the necessary internal dimensions that will reflect the acoustic pressure pulsations back into the upstream duct with a 180° phase shift at the desired frequency, thereby attenuating the acoustic pressure pulsations.

Controller 41 monitors engine parameters, such as engine speed, engine acceleration, throttle position, and pedal position. The controller 41 calculates the optimal position of the partition 24 based on the engine parameters. In doing this, controller 41 can utilize a lookup table of the partition position relative to both engine speed and performance characteristics. The lookup table could be developed from a series of induction noise tests to determine the optimal position for the partition at every engine speed. In addition, a position sensor 49 may be used to monitor the position of the partition 24 and provide feedback to the controller 41. Based on the feedback from the position sensor 49 and the engine's operating conditions, the controller commands the actuator 40 to move the partition 24 to the predetermined optimal position.

As a person skilled in the art will readily appreciate, the above description is meant as an illustration of the principles of this invention. This description is not intended to limit the scope or application of this invention in that the invention is susceptible to modification, variation and change, without departing from spirit of this invention, as defined in the following claims.

I/We claim:

1. An in-line resonator for an air induction system of an internal combustion engine comprising:

a resonator housing defining a compartment having a fixed volume and having an axis;

an upstream duct connected to the housing and extending therefrom;

a downstream duct connected to the housing opposite the upstream duct and extending therefrom;

a conduit connected with the upstream duct and extending through the housing, said conduit having a conduit end located within the downstream duct;

a partition located within the housing and dividing the compartment into an upstream chamber adjacent to the upstream duct and a downstream chamber adjacent to the downstream duct, said partition being axially moveable thereby changing volumes of said upstream chamber and said downstream chamber;

a sleeve including upstream and downstream portions positioned about said conduit axially, said downstream portion of the sleeve including inner and outer portions, radially spaced apart from each other, that cooperate with the conduit to define a connector passage connecting the downstream duct and the downstream chamber, said connector passage having a length defined between a downstream end of said conduit and an upstream end of the outer downstream sleeve, and said connector having a cross-sectional area defined by the annular gap between the inner downstream sleeve and outer downstream sleeve;

said downstream chamber, said conduit, and said inner and outer downstream sleeves cooperating to define a downstream Helmholtz resonator in fluid communication with said downstream duct through said connector passage, and further wherein said Helmholtz resonator is characterized by the volume of said downstream chamber, the cross-sectional area of said passage, and the length of said connector passage;

a sliding unit including said partition, said upstream sleeve, and said downstream sleeve; and an actuator coupled to said sliding unit and adapted to move the partition to vary the volume of said downstream chamber and concurrently to vary the length of said connector passage.

2. The in-line resonator of claim 1 wherein the conduit comprises at least one conduit opening communicating with the upstream chamber.

3. The in-line resonator of claim 2 wherein said at least one conduit opening includes a series of perforations communicating with the upstream chamber.

4. The in-line resonator of claim 2 wherein said upstream sleeve is slidably received about said conduit and coupled to said partition and said downstream sleeve for movement therewith, said upstream sleeve being movable to at least partially occlude said at least one conduit opening.

5. The in-line resonator of claim 4 wherein said upstream sleeve comprises at least one opening adapted to overlap with said at least one conduit opening to provide fluid communication between said upstream chamber and an interior of said conduit.

6. The in-line resonator of claim 5 wherein said at least one conduit opening and said opening in said upstream sleeve are sized and shaped to vary the size of the opening between the upstream chamber and the conduit as a function of the position of said upstream sleeve relative to said at least one conduit opening.

7. The in-line resonator of claim 5 wherein said at least one conduit opening and said opening in said sleeve are sized and shaped to vary the size of the opening linearly between the upstream chamber and the conduit as a function of the position of the sleeve relative to said at least one conduit opening.

8. The in-line resonator of claim 5 wherein said at least one conduit opening and said opening in said upstream sleeve are sized and shaped to vary the size of the opening non-linearly between the upstream chamber and the conduit as a function of the position of the upstream sleeve relative to said at least one conduit opening.

9. The in-line resonator of claim 5 wherein said at least one conduit opening and said opening in said upstream sleeve are sized and shaped to increase the size of the opening between the upstream chamber and the conduit as a function of the position of the upstream sleeve relative to said at least one conduit opening.

10. The in-line resonator of claim 5 wherein said at least one conduit opening and said opening in said upstream sleeve are sized and shaped to decrease the size of the opening between the upstream chamber and the conduit as a function of the position of the upstream sleeve relative to said at least one conduit opening.

11. The in-line resonator of claim 1 wherein the downstream duct includes a first extension located within the downstream chamber and spaced apart from the conduit, and wherein the outer downstream sleeve slides about the first extension.

12. The in-line resonator of claim 11, wherein the upstream sleeve is composed of inner and outer portions, radially spaced apart from each other, that cooperate with the conduit to define a connector passage connecting the upstream duct and the upstream chamber.

13. The in-line resonator of claim 11, wherein the upstream duct includes a second extension located within the upstream chamber and spaced apart from the conduit, and wherein the outer upstream sleeve is slides about the second extension.

14. The in-line resonator of claim 1 wherein the conduit end is radially spaced apart from the downstream duct.

15. The in-line resonator of claim 1 wherein said actuator includes a motor coupled to said sliding unit.

* * * * *